US009266116B1

(12) United States Patent
Doose

(10) Patent No.: US 9,266,116 B1
(45) Date of Patent: Feb. 23, 2016

(54) HYDRAULIC INJECTION MILLING APPARATUS WITH CLASSIFYING SCREEN

(71) Applicant: Eli Doose, Ouray, CO (US)

(72) Inventor: Eli Doose, Ouray, CO (US)

( * ) Notice: Subject to any disclaimer, the term of this patent is extended or adjusted under 35 U.S.C. 154(b) by 409 days.

(21) Appl. No.: 13/919,421

(22) Filed: Jun. 17, 2013

(51) Int. Cl.

| | |
|---|---|
| ***B02C 23/00*** | (2006.01) |
| ***B02C 23/38*** | (2006.01) |
| ***B02C 19/00*** | (2006.01) |
| ***B02C 23/16*** | (2006.01) |
| ***B02C 23/10*** | (2006.01) |
| ***B02C 23/14*** | (2006.01) |

(52) U.S. Cl.
CPC ..... *B02C 23/38* (2013.01); *B02C 19/00* (2013.01); *B02C 23/10* (2013.01); *B02C 23/14* (2013.01); *B02C 23/16* (2013.01); *B02C 23/00* (2013.01)

(58) Field of Classification Search
CPC ..... B02C 23/00; B02C 23/10; B02C 23/14; B02C 23/16; B02C 23/38
USPC ..... 241/152.1, 60, 38, 188.1, 186.3, 266, 241/264
See application file for complete search history.

(56) References Cited

U.S. PATENT DOCUMENTS

| | | | | |
|---|---|---|---|---|
| 2,243,406 | A * | 5/1941 | Comer | C01B 17/06 241/152.2 |
| 3,062,458 | A * | 11/1962 | Dearing | B02C 13/13 209/138 |
| 5,673,860 | A * | 10/1997 | Heinemann | B02C 4/02 241/1 |
| 5,897,063 | A * | 4/1999 | Patzelt | B02C 21/005 241/152.2 |
| 7,159,807 | B2 * | 1/2007 | Montag | B02C 23/12 241/152.2 |
| 7,931,220 | B2 * | 4/2011 | Grasso, Jr. | B02C 17/22 241/152.2 |

* cited by examiner

*Primary Examiner* — Faye Francis
(74) *Attorney, Agent, or Firm* — Crossley Patent Law

(57) ABSTRACT

A hydraulic injection milling apparatus with classifying screen that includes a hydraulic fluid injected into an impactor during operation, wherein crushed material delivered to the impactor is reducible to specific-sized particles transmittable through an interchangeable classifying screen disposed underlying a delivery aperture in the impactor, said classifying screen including a plurality of fixed width, elongate apertures disposed in parallel upon a durable plate member, said crushed material thus reduced in the impactor and then classified through the classifying screen as fluid-borne sediment, deliverable for sorting and recovery, whereby coarse grain material is excluded by the classifying screen and yield from the impactor is increased by the hydraulic fluid washing sediment therefrom.

3 Claims, 8 Drawing Sheets

HYDRAULIC INJECTION MILLING APPARATUS WITH CLASSIFYING SCREEN

BACKGROUND OF THE INVENTION

Various types of milling apparatuses are known in the prior art. However, what is needed is a hydraulic injection milling apparatus with classifying screen that includes a hydraulic fluid injected into an impactor during operation, wherein crushed material delivered to the impactor is reducible to specific-sized particles transmittable through an interchangeable classifying screen disposed underlying a delivery aperture in the impactor, said classifying screen including a plurality of fixed width, elongate apertures disposed in parallel upon a durable plate member, said crushed material thus reduced in the impactor and thence classified through the classifying screen as fluid-borne sediment, deliverable for sorting and recovery, whereby coarse grain material is excluded by the classifying screen and yield from the impactor is increased by the hydraulic fluid washing sediment therefrom.

FIELD OF THE INVENTION

The present invention relates to a hydraulic injection milling apparatus with classifying screen, and a method of milling ore thereby, and more particularly, to a hydraulic injection milling apparatus with classifying screen that includes a hydraulic fluid injected into an impactor during operation, wherein crushed material delivered to the impactor is reducible to specific-sized particles transmittable through an interchangeable classifying screen disposed underlying a delivery aperture in the impactor, said classifying screen including a plurality of fixed width, elongate apertures disposed in parallel upon a durable plate member, said crushed material thus reduced in the impactor and thence classified through the classifying screen as fluid-borne sediment, deliverable for sorting and recovery, whereby coarse grain material is excluded by the classifying screen and yield from the impactor is increased by the hydraulic fluid washing sediment therefrom.

SUMMARY OF THE INVENTION

The general purpose of the hydraulic injection milling apparatus with classifying screen, described subsequently in greater detail, is to provide a hydraulic injection milling apparatus with classifying screen which has many novel features that result in a hydraulic injection milling apparatus with classifying screen which is not anticipated, rendered obvious, suggested, or even implied by prior art, either alone or in combination thereof.

The present hydraulic injection milling apparatus with classifying screen has been devised to enable milling of ore without the need of centrifuging, instead processing crushed material through a classifying screen having a plurality of fixed-width elongate apertures disposed in parallel upon a durable plate member, whereby hydraulic fluid injected into the impactor yields sediment of particles, reduced to a size transmissible through the classifying screen, for sorting and recovery.

Crushed material introduced to the impactor is thus reduced through attrition to definite sized particles capable of transmission through the classifying screen, coarse grains are excluded, and the yield of reduced material is increased as sediment is washed from the impactor by the hydraulic fluid.

The present hydraulic injection milling apparatus with classifying screen, therefore, includes a toggle style jaw crusher communicating crushed ore to an impactor. The jaw crusher includes an eccentric shaft disposed in an eccentric bearing to crush ore between a jaw side wear plate and a fixed side ware plate, as is common in the art. However, the present jaw crusher includes a pair of retaining pins which enable quick release of a fixed side assembly to disconnect said fixed side assembly from a pair of jaw crusher side plates, whereby the jaw side wear plate and fixed side wear plate are accessible for replacement and maintenance, and a mechanical jaw subassembly is readily unclogged—as is sometimes necessary during crushing operations. Thus, the present jaw crusher enables expedient access to the mechanical jaw subassembly without the need of unbolting the components required to access said mechanical jaw subassembly, as is presently typical of jaw crushers seen in the art.

Moreover, the fixed side wear plate is secured to the fixed side assembly without the need of countersinking, bolting, or use of additional fasteners. An attachment aperture, disposed upon the fixed side assembly, is configured to releasably secure a fixed side wear plate attachment member, welded to the fixed side wear plate, in position upon the fixed side assembly. Use of high grade, AR500 steel is thus possible, at the fixed side wear plate, without problems engendered by penetration of additional fasteners therethrough, which can weaken the fixed side wear plate and create areas susceptible to erosion and malfunction during extended crushing operations.

The jaw crusher thus crushes ore to crushed material, and communicates said crushed material to an impactor. In the preferred embodiment herein disclosed, an auger spirals crushed material from an inverted conical distribution bin, disposed underlying the jaw crusher, to an input aperture disposed in a front cover plate of an impactor housing. Crushed material is reduced inside the impactor housing by an impactor arm assembly rotatably disposed therein. Hydraulic fluid (in the preferred embodiment, water) is introduced into the impactor housing by a half-inch water line disposed to outflow at the input aperture. The impactor arm assembly pressurizes the hydraulic fluid within the impactor housing during operation, and the hydraulic fluid drains through the classifying screen to bear reduced material as sediment through each of the plurality of elongate apertures disposed in parallel upon the screen plate member, to effect a greater yield than would otherwise occur by the influence of gravity alone.

The impactor housing includes a vertically oriented polygonal back impactor plate having a plurality of wall members perpendicularly disposed edgewise thereupon. Each of the plurality of wall members includes a housing flange disposed edgewise thereupon for interconnection with an impactor front cover plate that securably attaches thereto. The impactor arm assembly is rotatably disposed within the impactor housing by means of an impactor arm assembly axle disposed with a first end rotatably engaged at a front impactor shaft flange bearing, disposed upon the impactor front cover plate, and a second end rotatably engaged at a rear impactor shaft pillow block bearing, disposed upon the back impactor plate. The axle second end is rotationally engaged by an impactor shaft drive pulley in operational communication with a motor.

The impactor arm assembly includes a plurality of impactor arms radially disposed upon the impactor axle. In the preferred embodiment herein disclosed, the plurality of impactor arms includes four impactor arms disposed at right angles. Each of the plurality of impactor arms includes a paddle member angularly disposed endwise upon each impactor arm. The paddle members reduce crushed material introduced into the impactor housing during operation, and reduced material is passed through the classifying screen for delivery to a sorting apparatus.

The classifying screen is an interchangeable element novel to this device. The classifying screen includes a screen assembly positioned under a delivery aperture, said delivery aperture disposed in a lowermost one of the plurality of wall members perimetrically enclosing the impactor housing. The classifying screen includes a parallelepiped plate member, wrought from AR500 steel, having a plurality of fixed-width elongate apertures disposed in parallel thereupon. In the preferred embodiment, the width of the elongate apertures is at most 20,000ths of an inch. However, additional widths of the plurality of elongate apertures are contemplated for additional classifying screens interchangeable with the impactor, as will be described subsequently.

The plate member is removably supportable within a screen frame, and thereby fittable within a sloped discharge chute, disposed underlying the impactor housing delivery aperture, when a screen access port is opened. The discharge chute includes a delivery chute aperture disposed down slope from the screen access port, said delivery chute aperture securable to a delivery chute for communication of reduced material, transmitted through the classifying screen, to a sorting apparatus.

The screen assembly is enclosable in position within the discharge chute when a screen access plate is releasably secured to the screen access port by means of a cam lever. The plate member of a particular classifying screen is therefore readily accessible, for cleaning and maintenance, and readily interchangeable for use when milling different ores. For example, yield of silver from argentiferous ore is increased with use of a classifying screen having an aperture width that is greater than the aperture width of screens used when recovering gold from auriferous ore.

The width of the elongate apertures disposed on a particular screen plate member, therefore inhibits transmission of material coarser than the aperture width. Such coarse material is thereby limited from transmission to the sorting apparatus, and crushed material remains in the impactor housing until reduced to the specific size required for transmission through the classifying screen. Hydraulic fluid, pressurized within the impactor housing during operation, flushes reduced material from the impactor housing, through the classifying screen, for sorting and recovery at the sorting apparatus.

In the preferred embodiment herein disclosed, the sorting apparatus is contemplated to be a shaking table, although additional sorting apparatuses my by used in conjunction with the impactor herein disclosed. The classifying screen classifies crushed material, supplied to the impactor from the jaw crusher, to particular sized particles, effecting sorting at the shaking table, without coarser grains interfering with the sorting operation. Thus, increased yield is possible by use of the present hydraulic injection milling apparatus with classifying screen than with other milling apparatuses typical in the art, and centrifuging is unnecessary.

The present hydraulic injection milling apparatus with classifying screen is scalable, as desired, however the preferred embodiment herein disclosed has been contemplated for use in small-scale mining operations, including assaying and prospecting.

Thus has been broadly outlined the more important features of the present hydraulic injection milling apparatus with classifying screen so that the detailed description thereof that follows may be better understood and in order that the present contribution to the art may be better appreciated.

Objects of the present hydraulic injection milling apparatus with classifying screen, along with various novel features that characterize the invention are particularly pointed out in the claims forming a part of this disclosure. For better understanding of the hydraulic injection milling apparatus with classifying screen, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
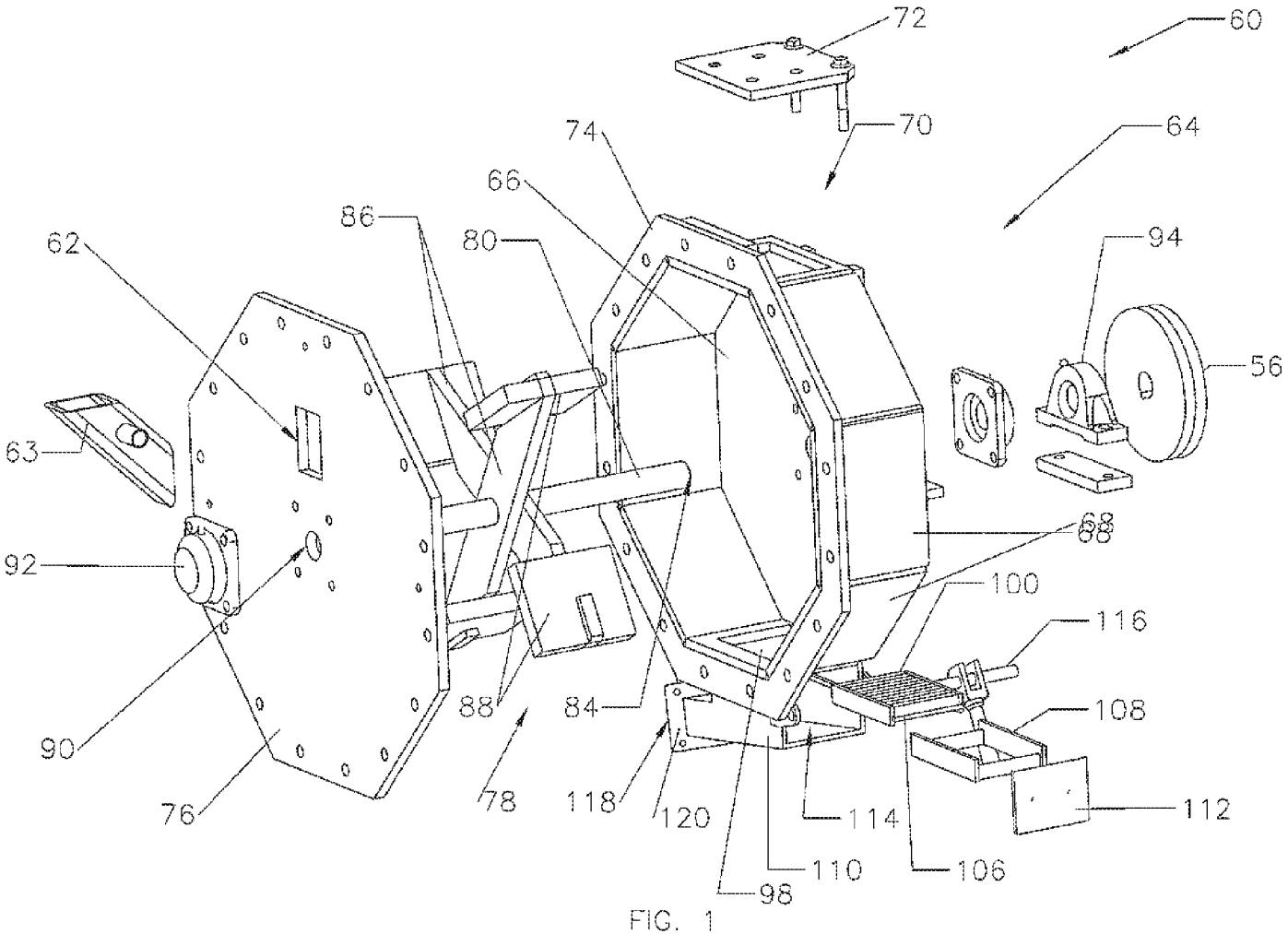
FIG. 1 is an exploded view of an impactor.
Figure 2:
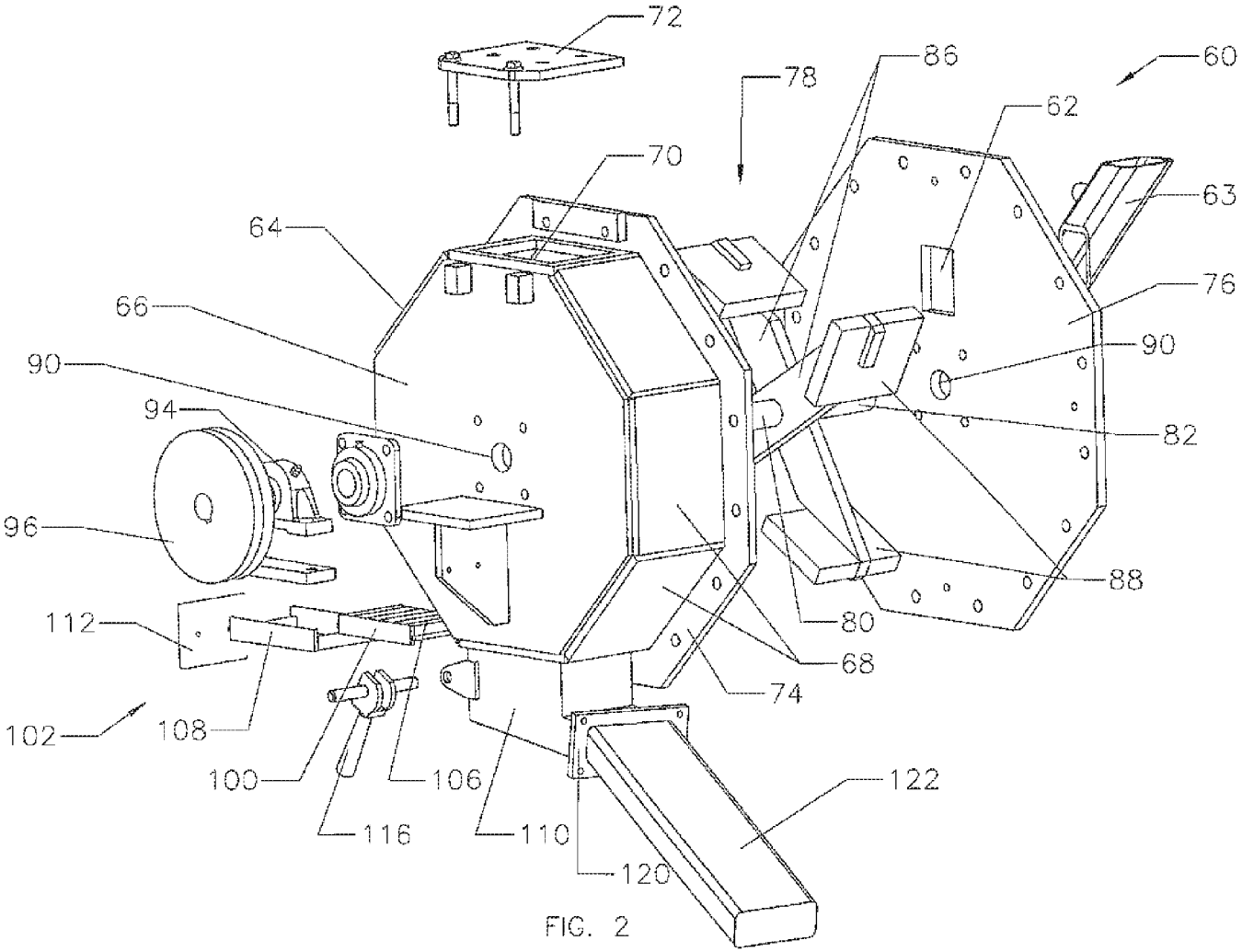
FIG. 2 is an exploded view of an impactor.
Figure 3:
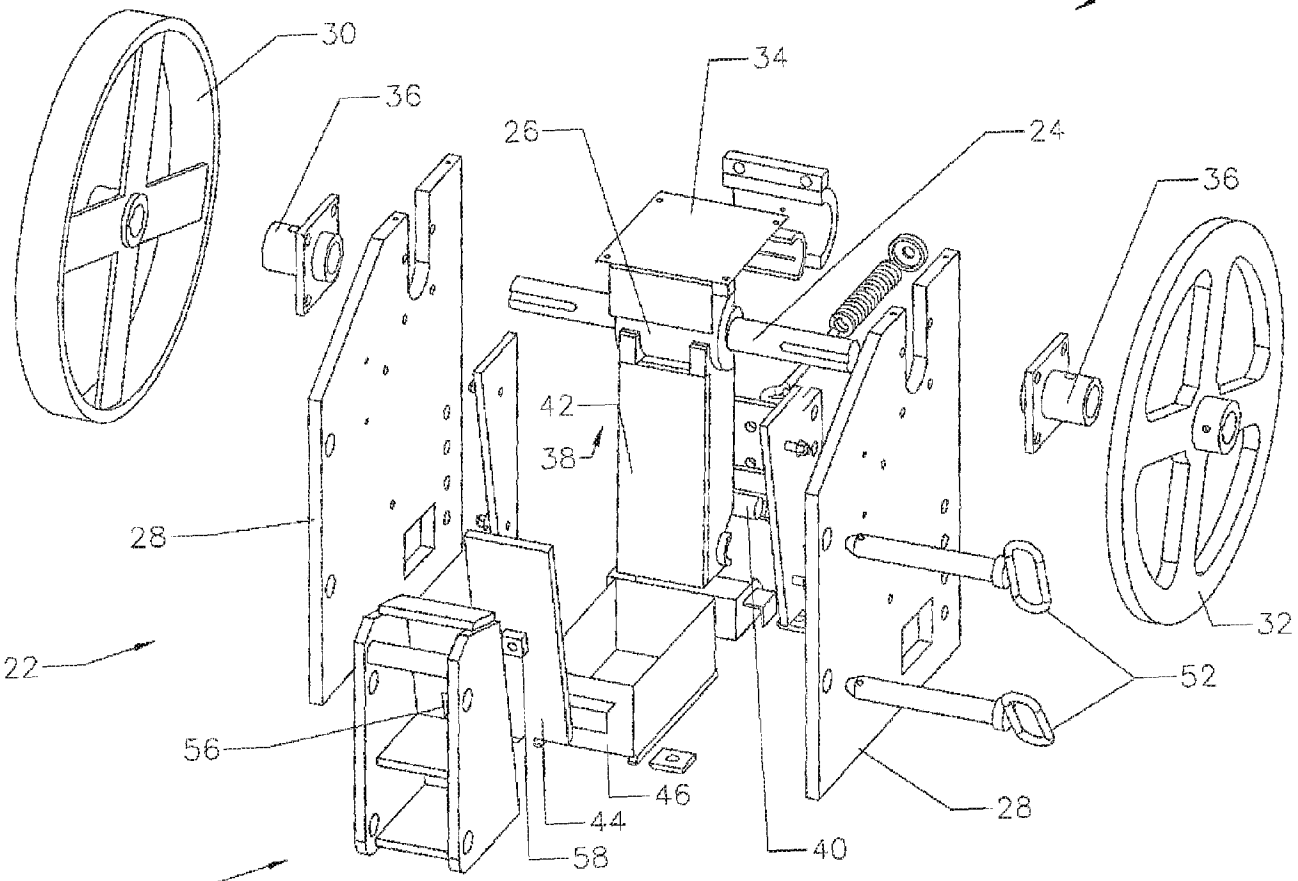
FIG. 3 is an exploded view of a jaw crusher.
Figure 4:
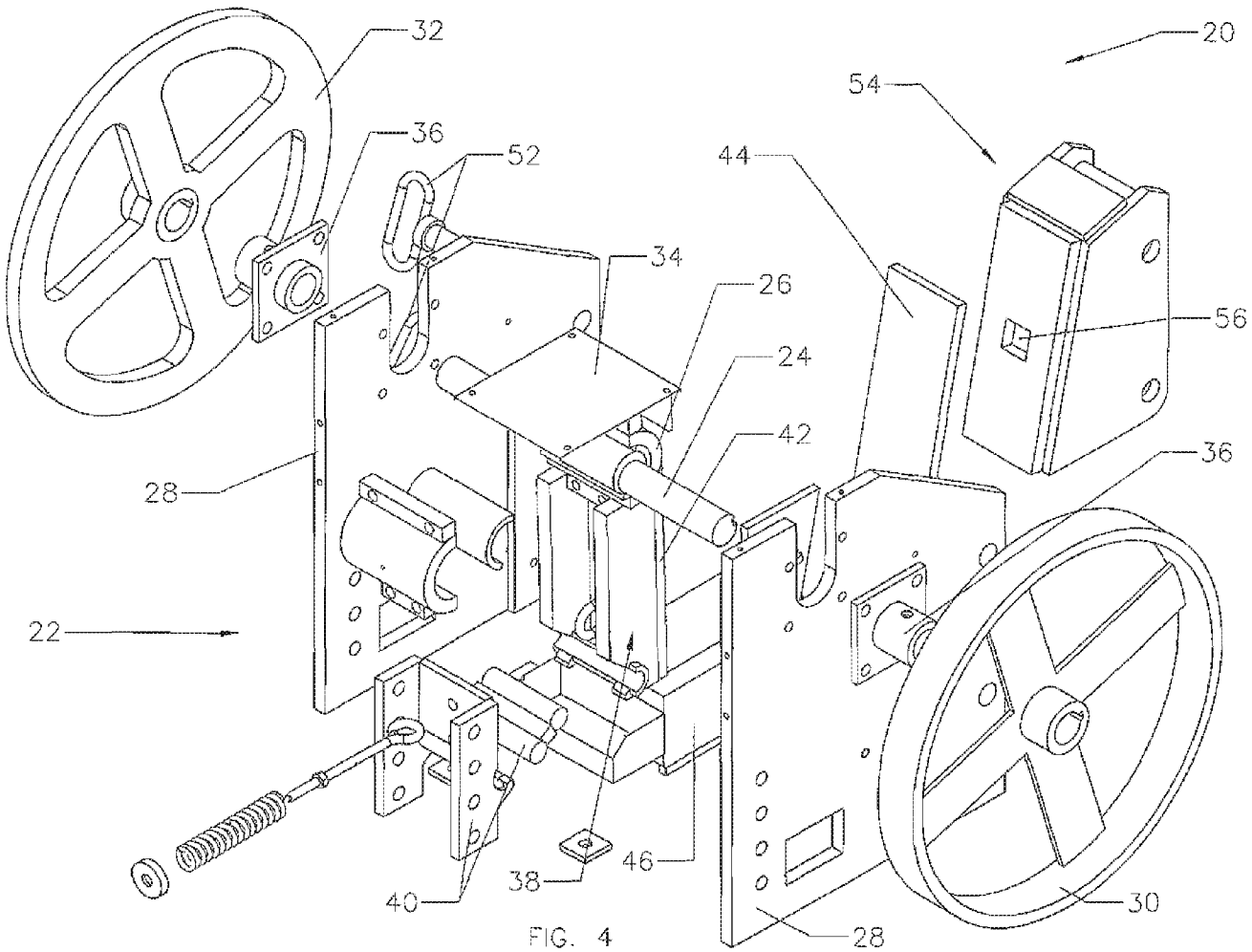
FIG. 4 is an exploded view of a jaw crusher.
Figure 5:
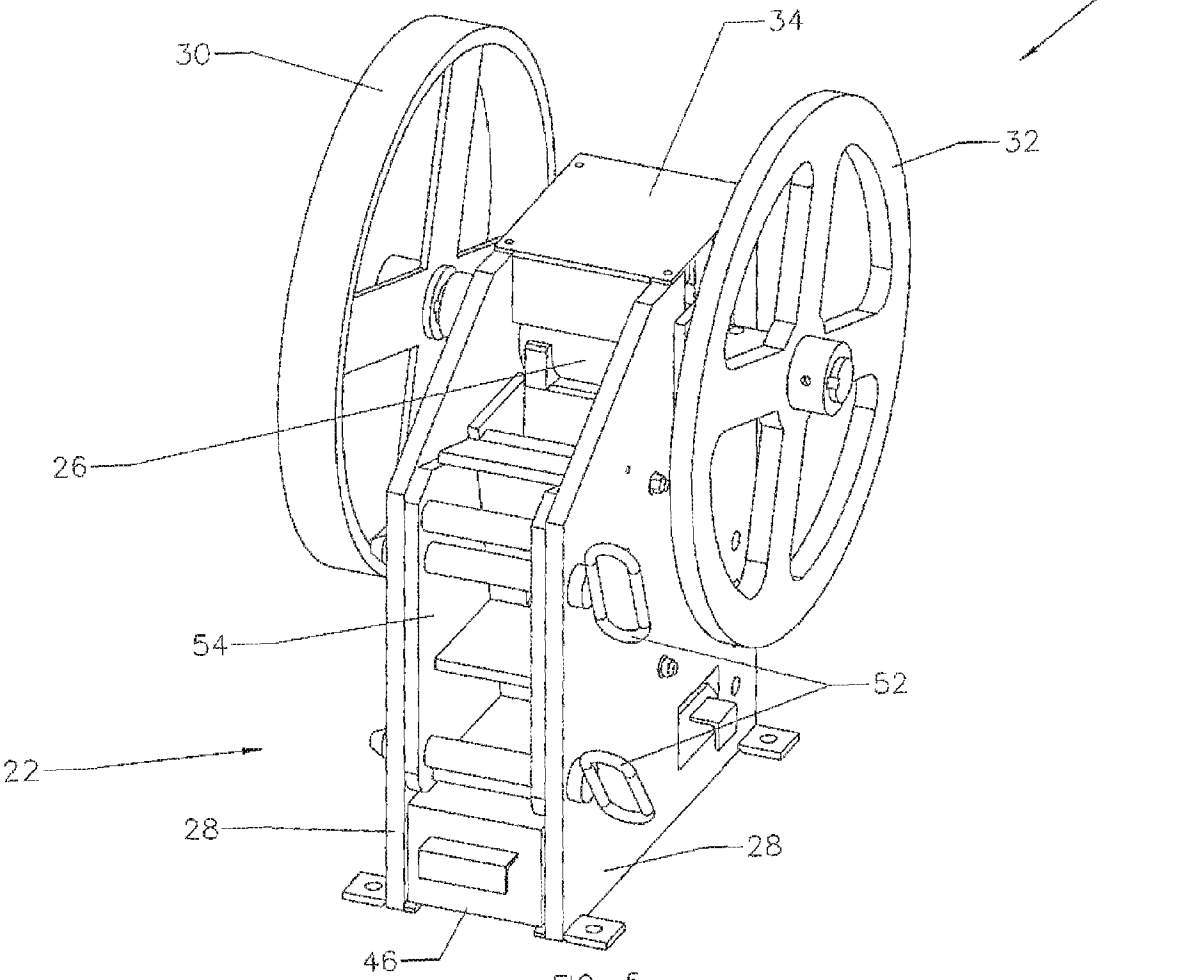
FIG. 5 is an isometric view of a jaw crusher.
Figure 6:
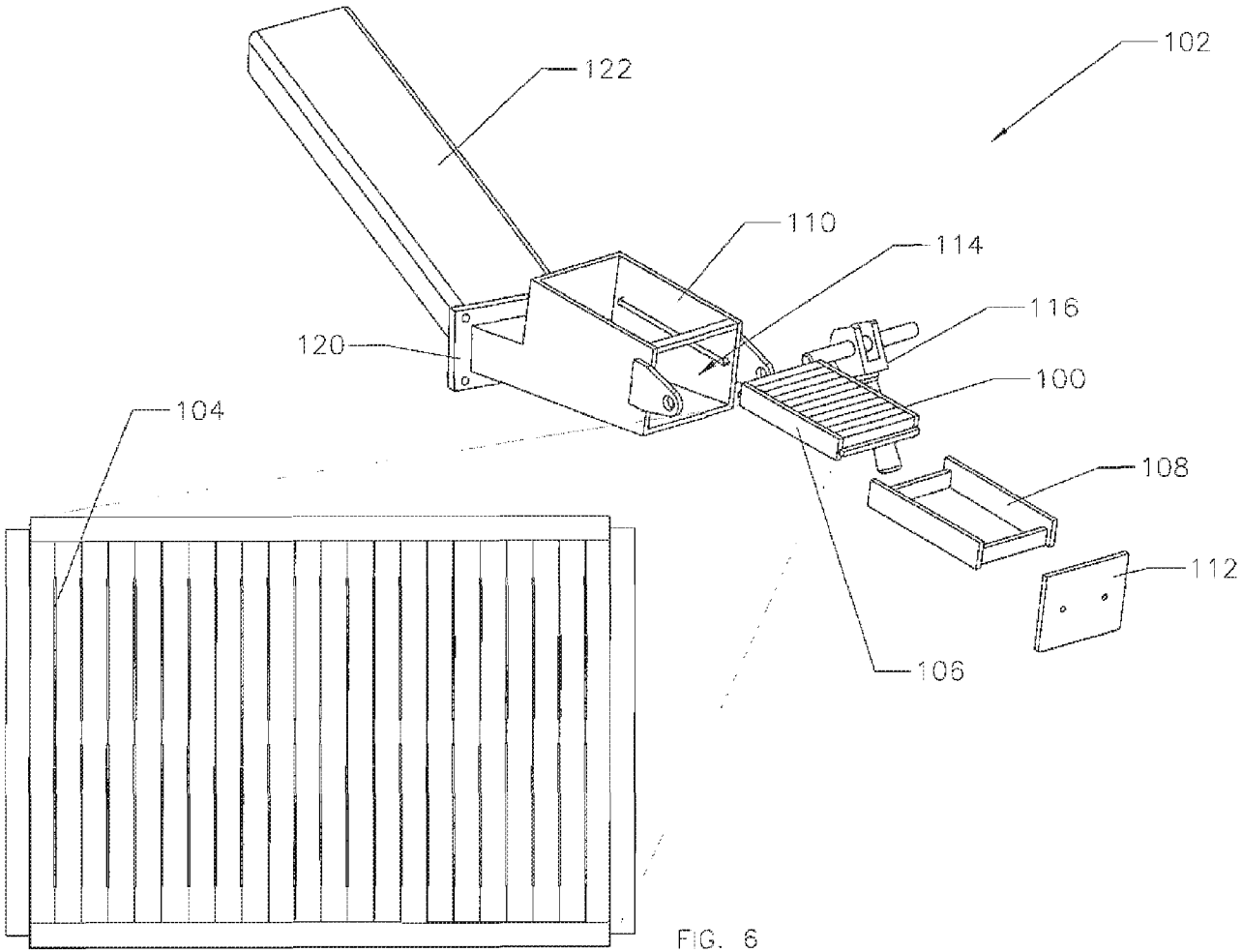
FIG. 6 is an exploded view of a classifying screen assembly and detail view of a classifying screen.
Figure 7:
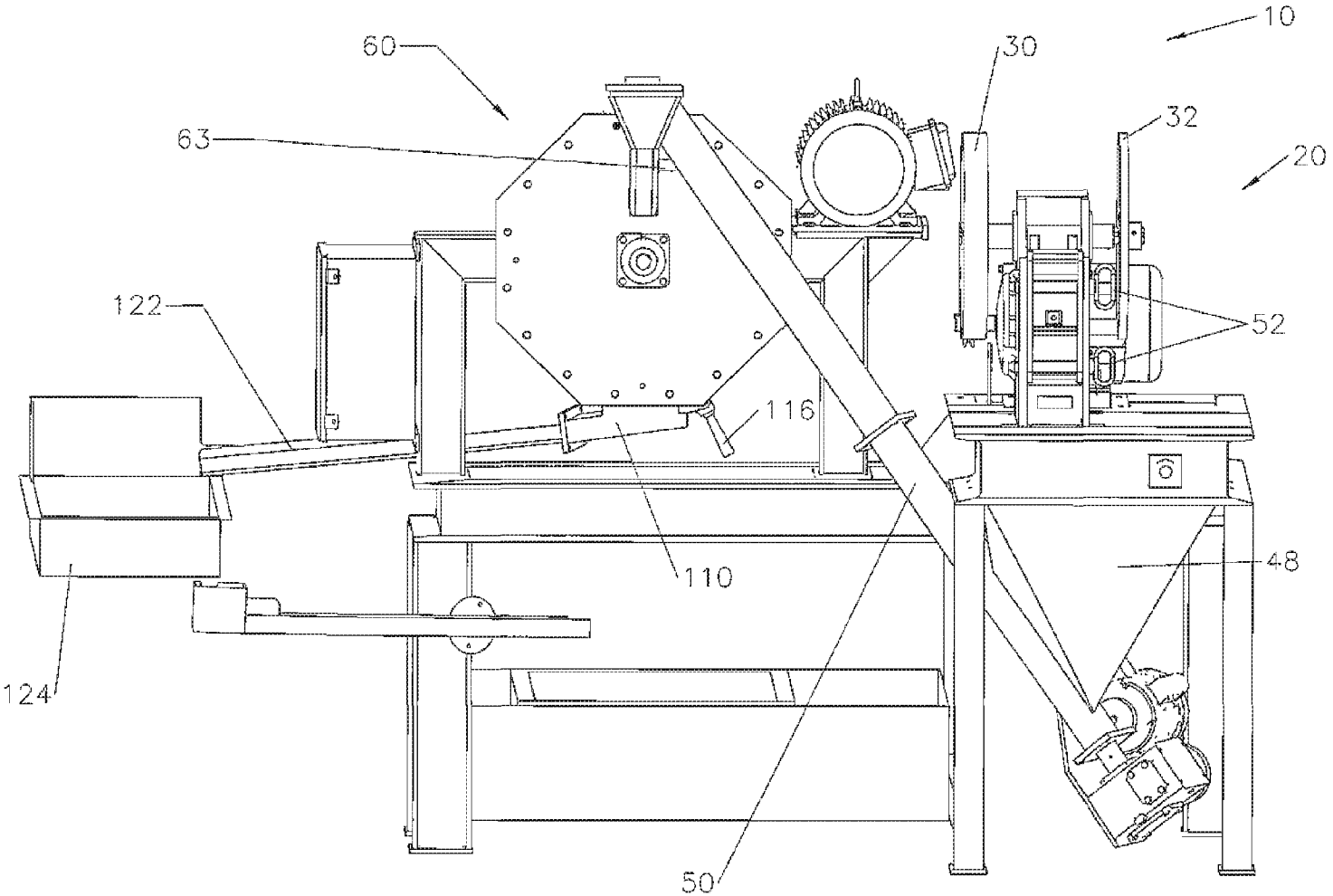
FIG. 7 is a side view of an embodiment.
Figure 8:
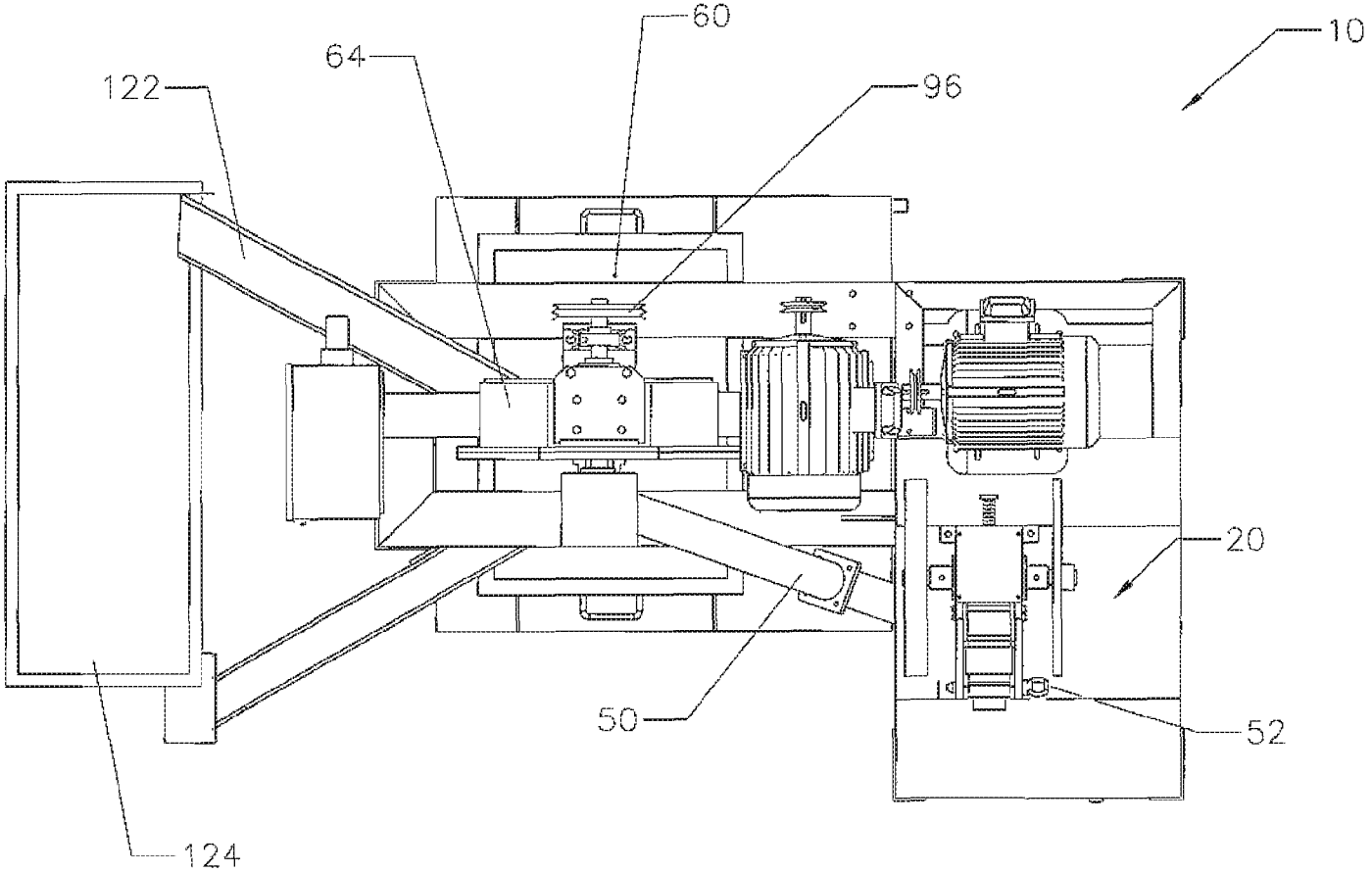
FIG. 8 is a top view of an embodiment.

With reference now to the drawings, and in particular FIGS. 1 through 8 thereof, example of the instant hydraulic injection milling apparatus with classifying screen employing the principles and concepts of the present hydraulic injection milling apparatus with classifying screen and generally designated by the reference number 10 will be described.

Referring to FIGS. 1 through 8 a preferred embodiment of the present hydraulic injection milling apparatus with classifying screen 10 is illustrated.

The present hydraulic injection milling apparatus with classifying screen 10 provides an improved means of recovering minerals from ore processed therein. The present hydraulic injection milling apparatus with classifying screen 10 does not require centrifuging to separate particles by density along separate acceleration curves—rather it reduces crushed material internal to an impactor housing 64, wherein material is reduced by attrition to a size transmissible through a classifying screen 100 disposed underlying a delivery aperture 98 in the impactor housing 64. Hydraulic fluid is injected into the impactor housing 64 to force the reduced material through the classifying screen 100 and recover nearly all the reduced material from the impactor housing 64 during milling operations. This is a marked improvement over milling impactors seen in the prior art, as less coarse grain is passed from the impactor 60 for sorting and recovery, and nearly all the ore introduced as crushed material is reduced and transmitted from the impactor 60 during operation for sorting and recovery.

One distinct feature of the present device 10 is the classifying screen 100, which includes an interchangeable plate member 106 having a plurality of elongate apertures 104 disposed in parallel thereon, said elongate apertures 104 set a fixed width apart. The plate member 106 is durable, preferably made from AR500 steel, and is supportable within a screen frame 108 and thence insertable into a screen assembly 102 disposed underlying a delivery aperture 98 in the impactor housing 64. Reduced material is communicated from the impactor 60 through the classifying screen 100 previous to discharge through a delivery chute 122 for sorting and recovery.

The classifying screen 100 is interchangeable for use when milling different ores, as case may be, where a greater or smaller aperture width is desired.

In the preferred embodiment herein disclosed, the hydraulic injection milling apparatus with classifying screen 10 includes a toggle style jaw crusher 20 disposed to communicate crushed material to an impactor 60 for reduction of the crushed material to sized particles transmissible through the classifying screen 100, thence from the impactor 60 to a shaking table 124 for sorting and recovery. Water is injected into the impactor 60 to force the reduced material from the impactor 60, through the classifying screen 100, for sorting and recovery at the shaking table 124.

The jaw crusher 20 includes a housing 22 containing an eccentric shaft 24 mounted in an eccentric bearing housing 26, said jaw crusher 20 disposed to receive ore and communicate crushed material to the impactor 60. The jaw crusher 20 includes a pair of jaw crusher side plates 28 disposed to support the eccentric shaft 24 between a drive pulley 30, disposed exteriorly relative one or the pair of jaw crusher side plates 28, and a fly wheel 32 disposed exteriorly relative the other of the pair of jaw crusher side plates 28. A mechanical jaw safety guard 34 is disposed overlying the eccentric bearing housing 26. An eccentric shaft flange bearing 36 is disposed enclosing the eccentric shaft 24 to prevent debris from spitting from the jaw crusher 20.

A mechanical jaw subassembly 38, disposed pivotally on a jaw crusher toggle mount 40, pivotally engages a jaw side wear plate 42 against a fixed side wear plate 44 to crush ore fed into the jaw crusher 20. The jaw crusher toggle mount 40 enables passage of crushed material into a sample bin 46 (for sample processing) when installed, or into a conical distribution bin 48, disposed apex downward, to feed said crushed material under the influence of gravity to an auger 50 spiraling the crushed material to an input aperture 62 disposed upon the impactor 60. The toggle mount 40 enables approximately a ⅜th of an inch eccentricity at the lower end of the mechanical jaw subassembly 38 to feed crushed material downward for distribution from the mechanical jaw subassembly 38.

Significant to the present device 10, a pair of retaining pins 52 releasably secures a jaw crusher fixed side assembly 54 to position the fixed side wear plate 44 for operation, and to expediently unclog the jaw crusher 20 should ore remain impacted therein. Release of each of the pair of retaining pins 52 enables ready removal of the jaw crusher fixed side assembly 54 to access clogged material, or to expediently replace the jaw side wear plate 42 and, alternately, the fixed side wear plate 44.

The fixed side wear plate 44 is secured to the fixed side assembly 54 by means of an attachment aperture 56 disposed in the fixed side assembly 54, said attachment aperture 56 sized to engage a fixed side wear plate attachment member 58 welded to the fixed side wear plate 44. The need for countersinking the fixed side wear plate 44 to the fixed side assembly 54 is therefore obviated, enabling use of high grade, durable steel, resistant to drilling.

The impactor 60 includes an impactor housing 64 wherein crushed material communicated thereto from the jaw crusher 20 is reduced to particles sized appropriate for transmission through the classifying screen 100. The impactor housing 64 includes a polygonal back impactor plate 66 having a plurality of sides. A plurality of wall members 68 is disposed perpendicularly edgewise upon each of the plurality of sides of the polygonal back impactor plate 66. An access aperture 70 is disposed in an uppermost one of the plurality of wall members 68, said access aperture 70 securably closeable by attachment of a top impactor access plate 72. A housing flange 74 is disposed perpendicularly edgewise upon each of the plurality of wall members 68 and a polygonal front impactor cover plate 76 is releasably securable to the housing flange 74 whereby the impactor housing 64 is enclosed.

The input aperture 62 is disposed upon the front cover plate 76 proximal the access aperture 70, and crushed material is deliverable internal to the housing 64 through the input aperture 62. An impactor arm assembly 78 is rotatably disposed within the housing 64, said impactor arm assembly 78 including an axle 80 having a first end 82 and a second end 84, and a plurality of impactor arms 86 radially disposed thereabouts. In the preferred embodiment herein disclosed, the plurality of impactor arms 86 includes four impactor arms disposed at right angles around the circumference of the axle 80 in a position along a medial longitudinal axes of the impactor housing 64. Each of the plurality of impactor arms 86 includes a paddle member 88 disposed angularly endwise thereupon, each paddle member 88 grinding crushed material introduced interior to the impactor housing 64 to reduced particles of a size capable of transmission through the classifying screen 100.

Each of a pair of axle apertures 90 is centrally disposed in each of the back impactor plate 66 and the front impactor cover plate 76. The impactor arm assembly 78 is rotatably supported by a front impactor shaft flange bearing 92, disposed upon the front impactor cover plate 76 overlying one of the pair of axle apertures 90, and a rear impactor shaft pillow block bearing 94, disposed overlying the other of the pair of axle apertures 90. The impactor arm assembly 78 is thereby rotatably supported upon the axle 80, said axle 80 oriented across a central transverse axis of the impactor housing 64. The impactor arm assembly 78 is operationally activated by a impactor shaft drive pulley 96, disposed in operational communication with the impactor arm axle 80 second end 84.

Thus, activation of the impactor arm assembly 78 is effected when the impactor shaft drive pulley 96 is activated, and the speed of rotation of the impactor arm assembly 78 is controllable thereby. In the preferred embodiment herein disclosed, the impactor arm assembly 78 is configured to run at 2,500 rpms. However, the speed of the impactor arm assembly 78, while speeding reduction of crushed material and thereby increasing the rate of yield, is not necessary for yielding particles of a desired size from the impactor 60, as is typical of centrifugal operations common in the art. Instead, crushed material is maintained within the housing 64 until said material is reduced to a size transmissible through the classifying screen 100. Once crushed material is reduced to said size, hydraulic pressure from hydraulic fluid injected into the impactor 60 forces such reduced material through the classifying screen 100 for sorting and recovery.

The classifying screen 100 is interchangeable and securable within a screen assembly 102 positioned underlying a delivery aperture 98 disposed in a lowermost one of the impactor 60 plurality of wall members 68. The interchangeable classifying screen 100 includes a plurality of fixed width, elongate apertures 104 disposed in parallel upon a durable classifying screen plate member 106. In the preferred embodiment herein disclosed, the classifying screen plate member 106 is wrought from AR500 steel and the width of each of the plurality of elongate apertures 104 is at most 20,000ths of an inch. However, additional classifying screens 100, having alternate widths of the plurality of elongate apertures 104, are contemplated as part of this invention 10, said additional classifying screens 100 interchangeable for use of the present apparatus with differing ores (for example, recovery of silver complexes in argentiferous ore is better effected through classifying screens 100 having greater width apertures 104 than those of screens 100 preferable for extracting gold from corresponding auriferous ores).

A screen frame 108 is removably securable to support the classifying screen 100 plate member 106, and thence insertable into a sloped discharge chute 110 disposed underlying the delivery aperture 98. The screen frame 108 is securable within the discharge chute 110 when a classifying screen 100 access plate 112 is releasably secured to close a screen access port 114 disposed upon the discharge chute 110. The screen access plate 112 is expediently secured in position closing the screen access port 114 by means of a moveable cam lever 116. Thus, interchange of classifying screens 100 may be rapidly undertaken when desired, by selective release and engagement of the cam lever 116.

A delivery chute aperture 118 is disposed upon the classifying screen assembly 102 down slope from the access port 114. A chute flange 120 is perpendicularly disposed around the delivery chute aperture 118 for interconnection with a delivery chute 122 for communication of the reduced material for sorting and recovery. In the preferred embodiment herein disclosed, the delivery chute 122 communicates reduced material yielded from the impactor 60 to a shaking table 124 for sorting and recovery.

Fluid (water, in the preferred embodiment herein disclosed) is introduced into the impactor 60 at the input aperture 62 by a fluid input line 63. The hydraulic fluid is pressurized inside the impactor housing 64 during operation of the impactor 60, and said hydraulic fluid drains through the classifying screen 100, bearing sediment of reduced material therethrough, for delivery to the shaking table 124 where particles are separable and recoverable. In the preferred embodiment herein disclosed, the hydraulic fluid is introduced into the impactor 60 by a half-inch water line.

Crushed material having coarser grains than reduced material transmissible through the classifying screen 100 is thus excluded from sorting and recovery, and crushed material remains internal to the impactor housing 64 until the required particle size is attained. The hydraulic fluid, pressurized during operation of the impactor 60, washes reduced material through the classifying screen 100 and increases yield from the impactor 60 than would otherwise occur under the influence of gravity or by centrifuging the reduced material. The present hydraulic injection milling apparatus with classifying screen 10 is thus a distinct improvement over the prior art.

What is claimed is:

1. A hydraulic injection milling system with classifying screen comprising a jaw crusher including a jaw crusher housing containing an eccentric shaft mounted in an eccentric bearing, said jaw crusher disposed to receive ore and communicate crushed material to an impactor by an auger, said impactor further comprising:

an impactor housing comprising:

a polygonal back impactor plate having a plurality of sides;

a plurality of wall members disposed perpendicularly edgewise upon each of the polygonal back impactor plate plurality of sides;

an access aperture disposed in one of the plurality of wall members;

a delivery aperture disposed in a lowermost one of the plurality of wall members;

a housing flange disposed perpendicularly edgewise upon each of the plurality of wall members;

a polygonal front impactor cover plate releasably securable to the housing flange;

a top impactor access plate releasably securable to cover the access aperture;

an input aperture disposed in the front cover plate proximal an uppermost one of the plurality of wall members, said input aperture connectable to the jaw crusher auger for input of crushed material therethrough;

each of a pair of axle apertures disposed in each of the back impactor plate and the front impactor cover plate;

a front impactor shaft flange bearing, disposed upon the front impactor cover plate overlying one of the pair of axle apertures;

a rear impactor shaft pillow block bearing, disposed overlying the other of the pair of axle apertures;

a screen assembly disposed underlying the delivery aperture, said screen assembly further comprising:

an interchangeable classifying screen having a plurality of fixed width, elongate apertures disposed in parallel upon a durable classifying screen plate member;

a screen frame removably securable to support the screen plate member, said screen frame insertable into a sloped discharge chute disposed underlying the delivery aperture, said screen frame securable therein when a classifying screen access plate is releasably secured to close a screen access port;

a delivery chute aperture disposed upon the classifying screen assembly down slope from the access port;

a chute flange perpendicularly disposed around the delivery chute aperture;

a delivery chute securable to the chute flange, said delivery chute communicating reduced material from the impactor to a shaking table for sorting and recovery;

an impactor arm assembly rotatably disposed inside the impactor housing, said impactor arm assembly further comprising an axle having a first end and a second end rotatably mounted in a respective one of the pair of axle apertures, and a plurality of impactor arms radially disposed thereabouts, said impactor arm assembly rotatable to reduce the crushed material communicated to the impactor down to specific sized particles transmissible through the classifying screen; and an impactor shaft drive pulley in operational communication with the impactor arm axle second end;

wherein hydraulic pressure internal to the impactor housing forces reduced material, degraded by action of the impactor arm assembly, through the plurality of elongate apertures disposed upon the classifying screen to the delivery chute for sorting and recovery.

2. The hydraulic injection milling system with classifying screen of claim 1 wherein the jaw crusher includes a pair of retaining pins removably securing a fixed side assembly to position a fixed side wear plate for crushing ore, said pair of retaining pins expediently removable whereby the jaw crusher is readily unclogged and each of a mechanical jaw wear plate and the fixed side wear plate are replaceable.

3. The hydraulic injection milling system with classifying screen of claim 2 wherein the jaw crusher further comprises an attachment aperture disposed in the fixed side assembly, said attachment aperture sized to releasably engage the fixed side wear plate in position without the need for countersinking the fixed side wear plate thereto.

* * * * *